US007708378B2

(12) United States Patent
Katada

(10) Patent No.: US 7,708,378 B2
(45) Date of Patent: May 4, 2010

(54) INK CARTRIDGE, INK JET RECORDING APPARATUS AND WASTE-INK CARTRIDGE

(75) Inventor: Masahito Katada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 421 days.

(21) Appl. No.: 11/480,891

(22) Filed: Jul. 6, 2006

(65) Prior Publication Data

US 2007/0008372 A1 Jan. 11, 2007

(30) Foreign Application Priority Data

Jul. 8, 2005 (JP) ..... 2005-200456

(51) Int. Cl.
*B41J 2/165* (2006.01)

(52) U.S. Cl. ..... 347/36

(58) Field of Classification Search ..... None
See application file for complete search history.

(56) References Cited

U.S. PATENT DOCUMENTS 6,203,137 B1 * 3/2001 Niimura et al. ..... 347/36
6,629,750 B2 * 10/2003 Ciordia ..... 347/36
7,197,266 B2 * 3/2007 Fordahl et al. ..... 399/237
2004/0263554 A1 * 12/2004 Kubo ..... 347/18
2005/0128244 A1 * 6/2005 Kulpa et al. ..... 347/35

FOREIGN PATENT DOCUMENTS

JP 10-244665 A 9/1998

* cited by examiner

*Primary Examiner*—Stephen D Meier
*Assistant Examiner*—Alexander C Witkowski
(74) *Attorney, Agent, or Firm*—Birch, Stewart, Kolasch & Birch, LLP

(57) ABSTRACT

A case body of an ink cartridge has a recording ink storage chamber containing a recording ink and a waste-ink storage chamber containing an ink coagulant. The recording ink is supplied to a recording head of an ink jet recording apparatus. A head cleaning unit collects waste-ink from the recording head and feeds it to the waste-ink storage chamber. A heater heats the waste-ink and the ink coagulant in the waste-ink storage chamber, so that the ink coagulant melts and mixes with the waste-ink. The mixture of the ink coagulant and the waste-ink is cooled and solidified into gel. The gelled mixture of the waste-ink and the ink coagulant can be easily taken out of the waste-ink storage chamber by heating to liquefy it again, facilitating recycling the case body.

17 Claims, 5 Drawing Sheets

INK CARTRIDGE, INK JET RECORDING APPARATUS AND WASTE-INK CARTRIDGE

FIELD OF THE INVENTION

The present invention relates to an ink cartridge for supplying ink to an ink jet type recording head that discharges ink from an array of nozzles arranged in a discharging surface, and an ink jet recording apparatus, which the ink cartridge is removably attached to. The present invention further relates to a waste-ink cartridge for storing waste-ink as collected by cleaning the recording head.

BACKGROUND ARTS

An ink jet recording apparatus has been known, which has a recording head for discharging ink as droplets onto a recording paper to print an image. The ink jet recording apparatus is provided with at least an ink container containing ink, to supply the ink from the ink container to the recording head. In an example, the recording head is provided with nozzles and an oscillation plate driven by a piezoelectric element. Making use of pressure change in the nozzles, which is caused by oscillating the oscillation plate, the ink is sucked from the ink container into the nozzles, and is discharged through ink outlets of the nozzles. Because the ink is a consumable material, the ink container is often formed as a cartridge that is removably attached to the ink jet recording apparatus, so that the ink may be supplied conveniently.

In the ink jet recording apparatus, the ink can stick to the ink outlets of the nozzles as it is dried to be viscous. Paper particles from the recording paper or dusts can also stick to the ink outlets. If the ink outlets are clogged with such obstacles, the recording head cannot discharge the ink, or ejects the ink in wrong direction. Besides that, if air bubbles enter inside the nozzles, ink discharging from the outlets becomes unstable.

To avoid these troubles, many of the ink jet recording apparatuses are provided with a capping mechanism that covers the outlets of the nozzles, as arranged on a discharging surface, with a cap while the recording head is at rest, to prevent the ink from being dried at the outlets, and/or a head cleaning device, such as a vacuum recovery mechanism that sucks viscous portions of the ink or air bubbles together with the ink out of the nozzles while covering the nozzles with a cap that is connected to a suction pump, or a wiping mechanism that wipes the obstacles like sticky ink and paper particles off the discharging surface, using an elastic wiper made of rubber or the like.

The ink sucked or wiped out of the recording head, hereinafter called waste-ink, is conventionally collected, for example through the suction pump, into a waste-ink container that is removably attached to the ink jet recording apparatus. The waste-ink container is changed with another when the waste-ink accumulated in the waste-ink container gets to a certain amount. In order to prevent spilling the waste-ink from the container as it is detached from the recording apparatus, Japanese Laid-open Patent Application No. Hei 10-244665 suggests inserting a high water absorbent polymer in the waste-ink container, so that the collected waste-ink is absorbed and coagulated by the polymer.

In order to make it easy and convenient for the user or operator to change the waste-ink container, it is desirable to form the waste-ink container as a cartridge, and insert a high water absorbent polymer or the like in the cartridge so as to prevent leakage of the waste-ink.

For the purpose of reducing load on the environment, the above-described ink cartridges are collected after use by the manufacturers, so as to recycle the containers of the used ink cartridges after disposing of the residual ink appropriately. As for the waste-ink container formed as a cartridge, hereinafter called the waste-ink cartridge, it is also desirable to collect and recycle the waste-ink cartridge after it is filled up with the waste-ink and removed from the ink jet printer. However, if the waste-ink is coagulated by the high water-absorbent polymer or the like in the waste-ink cartridge and the waste-ink cartridge has a tight case body for preventing leakage of the waste-ink, it is hard to take out the waste-ink from the waste-ink cartridge. In that case, the waste-ink cartridge must be disassembled to take out the waste-ink, which raises the requisite number of processes for recycling and thus raises the cost for recycling.

SUMMARY OF THE INVENTION

In view of the foregoing, a primary object of the present invention is to provide such a cartridge that stores waste-ink as collected from an ink jet type recording head, and securely prevents leakage of the waste-ink when the cartridge is removed from an ink jet recording apparatus, but facilitates recycling the removed cartridge.

Another object of the present invention is to provide an ink jet recording apparatus for use with the inventive cartridge.

A waste-ink cartridge of the present invention comprises a waste-ink storage portion for storing waste-ink collected by cleaning an ink jet type recording head, and an ink coagulant contained in the waste-ink storage portion, wherein the ink coagulant melts as heated up to a melting temperature and mixes with the stored waste-ink and, thereafter, solidifies the stored waste-ink as cooled.

The present invention also provides an ink cartridge for supplying ink to an ink jet type recording head that has nozzles to discharge the ink toward a recording material. The ink cartridge of the present invention comprises a recording ink storage portion storing the ink to be supplied to the recording head, a waste-ink storage portion for storing waste-ink collected by cleaning the recording head, and an ink coagulant contained in the waste-ink storage portion, wherein the ink coagulant melts as heated up to a given melting temperature and mixes with the stored waste-ink and, thereafter, solidifies the stored waste-ink as cooled.

The ink coagulant contained in the waste-ink storage portion preferably has a property that the ink coagulant and thus the solidified waste-ink are liquefied again as they are heated, and solidified again as they are cooled.

The ink coagulant is preferably made of at least one of agar, gelatin, karaginan and pectin.

According to a preferred embodiment, the recording ink storage portion and the waste-ink storage portion are provided by sectioning a case body of the ink cartridge into two chambers.

According to another preferred embodiment, the recording ink storage portion and the waste-ink storage portion are constituted of two ink bags contained in a case body of the ink cartridge.

An ink jet recording apparatus of the present invention, wherein outlets of nozzles of a recording head are arranged in a discharging surface, comprises a cartridge mounting section for removably mounting at least an ink cartridge that has a waste-ink storage portion for storing waste-ink collected from the recording head, the waste-ink storage portion containing an ink coagulant that melts as heated up to a given melting temperature and mixes with the stored waste-ink and, thereafter, solidifies the stored waste-ink as cooled; a head cleaning device for cleaning the recording head to collect the waste-ink and feed the collected waste-ink to the waste-ink storage portion of the ink cartridge as mounted to the cartridge mounting section; a heating device for heating the ink cartridge as mounted to the cartridge mounting section; and a temperature controller for driving the heating device to heat the ink cartridge till the ink coagulant is melted into the stored waste-ink.

The head cleaning device preferably comprises at least one of a vacuum smoothing mechanism for sucking the ink and any obstacles out of the nozzles, and a wiper for wiping the ink off the discharging surface, and feeds the ink sucked by the vacuum smoothing mechanism and/or the ink wiped off the discharging surface as the waste-ink to the waste-ink storage portion.

Where the ink cartridge has the waste-ink storage portion in addition to a recording ink storage portion storing the ink to be supplied to the recording head, the ink jet recording apparatus further comprises a detection device for detecting that the ink in the recording ink storage portion is used up. In that case, the temperature controller starts driving the heating device when the detection device detects that the ink is used up.

Since the waste-ink storage portion contains the ink coagulant that melts into the waste-ink as heated up to the melting temperature, and solidifies the waste-ink as cooled, the waste-ink is surely prevented from leaking if the waste-ink is solidified before the cartridge is removed from the ink jet recording apparatus. Because the solidified waste-ink and the ink coagulant are liquefied again as heated up to the melting temperature, it is easy to take out them from the waste-ink storage portion, which facilitates recycling the cartridge.

BRIEF DESCRIPTION OF THE DRAWINGS

The above and other objects and advantages of the present invention will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
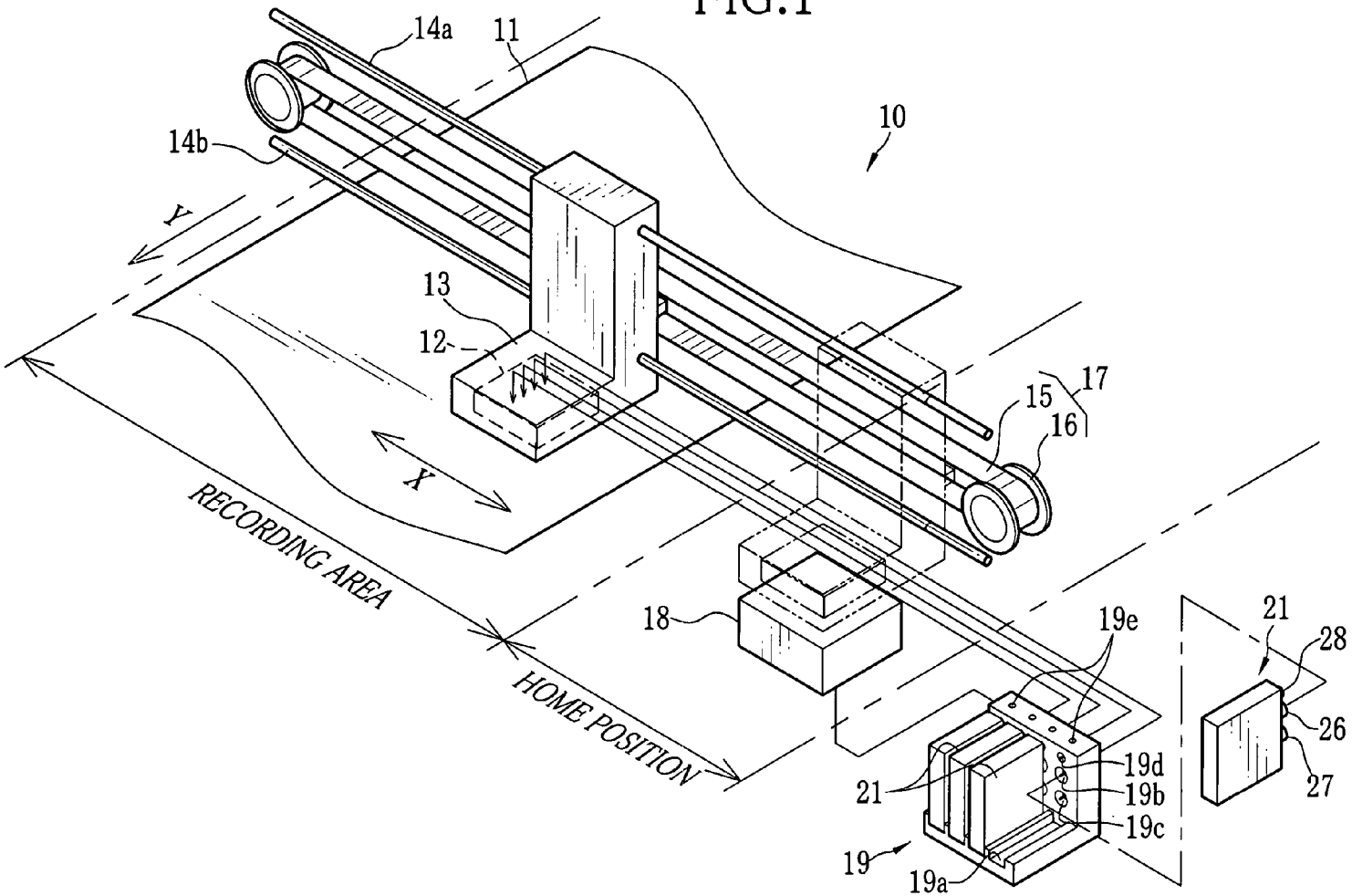
FIG. 1 is an explanatory diagram illustrating essential elements of an ink jet recording apparatus according to an embodiment of the invention.

An ink jet recording apparatus 10 shown in FIG. 1 is provided with a recording head 12 that discharges ink toward a paper sheet 11 to print images thereon. The recording head 12 is provided with a plurality of nozzles for discharging the ink from individual outlets. The outlets of the nozzles are aligned according to colors in a plane to form a discharging surface, and the discharging surface is placed in face to a recording surface of the paper sheet 11. The recording head 12 is mounted in a carriage 13 that is movable in a widthwise direction of the paper sheet 11, that is, a main scanning direction X. The discharging surface is exposed through an opening formed through a bottom of the carriage 13. While reciprocating together with the carriage 13 in the widthwise direction of the paper sheet 11, the recording head 12 records an image in a line sequential fashion. Each time the recording head 12 makes one lap to record a line of the image, the recording paper 11 is fed by not-shown conveyer rollers in a sub scanning direction Y, which is orthogonal to the main scanning direction X, by a length corresponding to a width of each image line as recorded by the recording head 12. Thus, a frame of image is recorded line after line.

The carriage 13 is mounted on a pair of guide rods 14*a* and 14*b* to slide thereon, and is driven by a belt mechanism 17 consisting of a belt 15 and a pair of pulleys 16. One end or terminal area of the belt mechanism 17 is defined as a home position where the discharging surface of the recording head 12 does not face the paper sheet 11. As shown by phantom lines in FIG. 1, the carriage 13 is held in the home position while the ink jet recording apparatus 10 is at rest, e.g., while it is disconnected from a power source or in a standby state. While the recording head 12 is recording an image, the carriage 13 moves out of the home position and reciprocate in the main scanning direction X across a recording area where the recording head 12 faces the paper sheet 11.

The ink jet recording apparatus 10 is provided with a cartridge mounting section 19 for mounting ink cartridges 21, e.g. four ink cartridges containing inks of four different colors: yellow, magenta, cyan and black. The cartridge mounting section 19 is provided with four slots 19*a*, into which the four ink cartridges 21 are removably plugged. In the recording head 12, oscillation plates are provided in correspondence to the respective nozzles. The oscillation plates are driven individually by piezoelectric elements, to change pressure inside the tube 32. Thereby, the ink in the ink cartridge 21 is sucked into the nozzles, and is ejected from the outlets of the nozzles.

In the home position, the discharging surface of the recording head 12 is opposed to a head cleaning unit 18, which wipes the ink, paper particles and dusts off the discharging surface, and sucks sticky ink and air bubbles out of the nozzles to prevent clogging of the nozzles. The head cleaning unit 18 cleans the discharging surface at predetermined timings, e.g. immediately after the recording head 12 is powered on, and immediately before and after the image recording operation. The head cleaning unit 18 collects the ink as removed from the recording head 12, hereinafter called waste-ink, and other obstacles, and drains them toward the ink cartridge 21.

Figure 2:
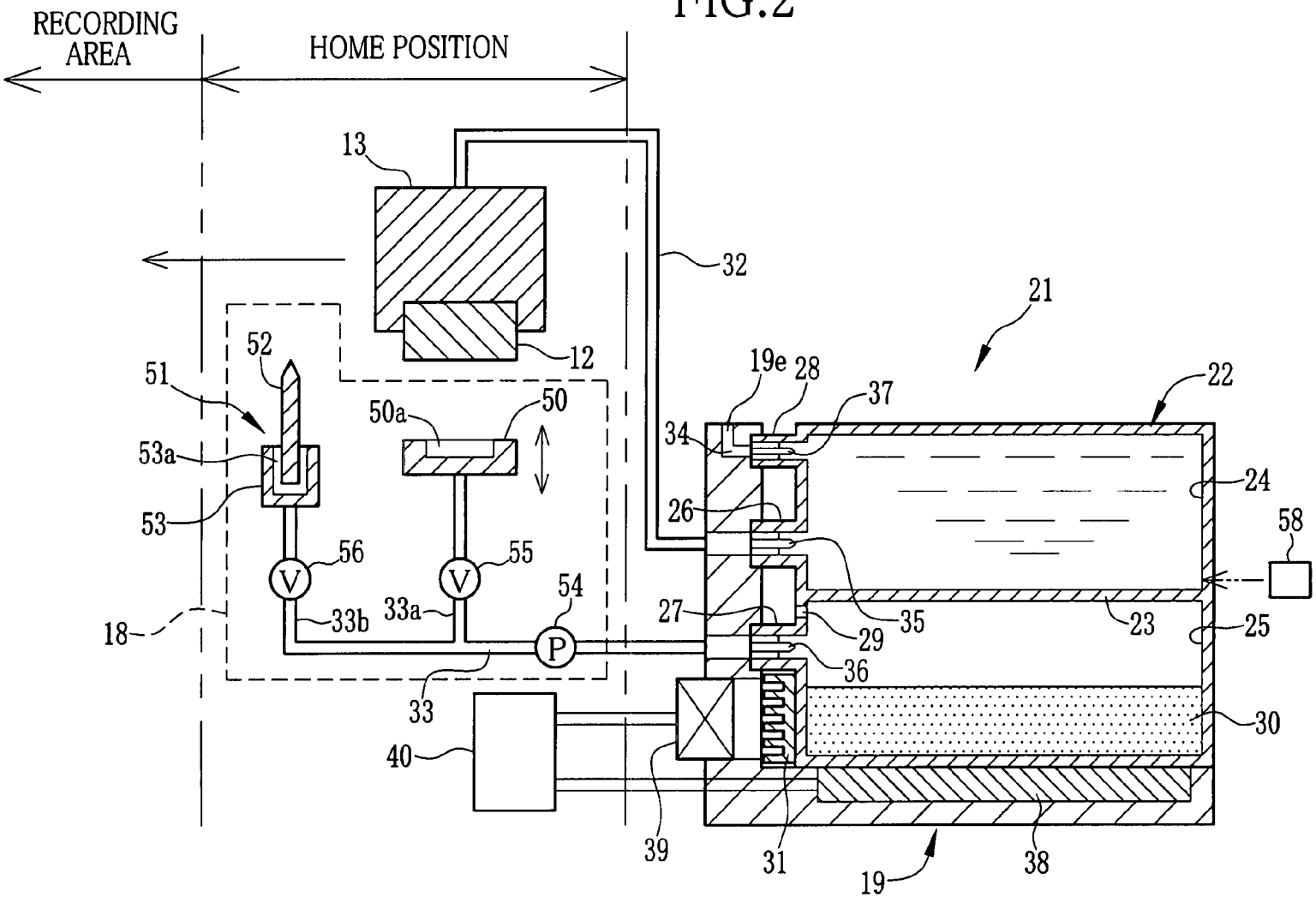
FIG. 2 is an explanatory diagram illustrating an ink cartridge and a head cleaning unit of the ink jet recording apparatus.

As shown in FIG. 2, a hollow case body 22 of the ink cartridge 21 is divided by a partition wall 23 into an upper chamber 24 and a lower chamber 25. The upper chamber 24 is used as a recording ink storage chamber 24 for storing the ink to be supplied to the recording head 12, whereas the lower chamber is used as a waste-ink storage chamber 25 for storing the waste-ink as collected by the head cleaning unit 18. Since the ink cartridge 21 of this embodiment not only supplies the ink but also accepts the waste-ink, the user has only to change the ink cartridge 21 when the ink in the recording ink storage chamber 24 is used up. Disposal of the waste-ink may be done simultaneously with recycling of the used-up ink cartridge 21. Although the partition wall 23 divides the case body 22 substantially into halves in the illustrated embodiment, the position of the partition wall 23, i.e. the ratio in volume between the recording ink storage chamber 24 and the waste-ink storage chamber 25, may be defined appropriately according to an estimated amount of waste-ink to be collected from one ink cartridge 21.

On one side of the case body 22, there are provided an ink outlet for letting the recording ink out of the recording ink storage chamber 24, a waste-ink inlet 27 for letting the waste-ink into the waste-ink storage chamber 25, an air inlet 28 for letting the air into the recording ink storage chamber 24 by an amount corresponding to the ink supplied to the recording head 12, and a vent hole 29 for keeping pressure inside the waste-ink storage chamber 25 equal to atmospheric pressure. Each of the outlet 26, the inlet 27 and the air inlet 28 consists of a hole formed through the one side of the case body 22, and a cylindrical sheave protruding outward from the rim of the hole. The case body 22 is made of a transparent plastic or the like, so that the recording ink and the waste-ink in the respective chambers 24 and 25 are visible from outside. In order to hinder leakage of the ink from the chambers 24 and 25, the ink outlet 26, the waste-ink inlet 27 and the air inlet 28 are mounted individually with a filter formed from a porous material and a valve mechanism, though they are omitted from the drawings.

The recording ink storage chamber 24 is also provided with a not-shown prism used for detecting that the recording ink is used up. The prism is located on the opposite side from the ink outlet 26, near the bottom of the recording ink storage chamber 24. The peak of the prism is oriented inward of the recording ink storage chamber 24. A residual ink detection sensor 58 is disposed in the ink jet recording apparatus 10, in a position facing to the prism of the ink cartridge 21 as plugged in the slot 19*a*. As an example, the residual ink detection sensor 58 is a photo-interrupter that consists of a light emitter for emitting light toward the prism, and a light receiver for receiving light reflected from the prism. The residual ink detection sensor 58 outputs a signal whose level corresponds to the volume of the reflected light from the prism. With a change in the ink level in the recording ink storage chamber 24, the volume of the reflected light from the prism changes, so the ink jet recording apparatus 10 detects based on the signal level from the residual ink detection sensor 58 that the recording ink storage chamber 24 is running out of the ink.

The waste-ink storage chamber 25 contains an ink coagulant 30 for coagulating the waste-ink after it is fed into the waste-ink storage chamber 25. The ink coagulant 30 is initially contained as a dry solid material, and has a property that it melts as heated up to a certain temperature, and gets solid as cooled. The ink coagulant 30 is water-soluble, so it is dissolved in the waste-ink when the ink coagulant 30 is heated and melted after the waste-ink is fed in the waste-ink storage chamber 25. As the mixture of the ink coagulant 30 and the waste-ink cools down, it is solidified into gel. The gelled mixture of the ink coagulant 30 and the waste-ink may be repeatedly melted and solidified by heating and cooling it.

Therefore, if the waste-ink is coagulated when the ink cartridge 21 is removed from the slot 19*a*, the waste-ink is surely prevented from leaking. In view of the environmental safety of the waste disposal, it is preferable to use as the ink coagulant 30 a naturally-derived material, such as agar, gelatin, karaginan or pectin. Beside the natural materials, water-soluble resin materials that are melted and solidified by heating and cooling them, e.g. SBR (styrene-butadiene rubber) are usable as the ink coagulant 30. Instead of the solid ink coagulant 30, powdery or flaky ink coagulant is usable.

Heat radiation fins 31 are provided on the same side of the case body 22 as the ink outlet 26 and 27 are formed. The heat radiation fins 31 are located in opposition to the waste-ink storage chamber 25, so as to promote heat radiation on cooling the melted ink coagulant 30. The heat radiation fin 31 may be formed from a material with high heat conductivity, like a metal, and then affixed to the case body 22. The heat radiation fin 31 may also be formed integrally with the case body 22.

Referring back to FIG. 1, the cartridge mounting section 19 is provided with fitting holes 19*b*, 19*c* and 19*d*, which are respectively fitted on the ink outlet 26, the waste-ink inlet 27 and the air inlet 28 as the ink cartridge 21 is plugged in the individual slot 19*a*. The fitting hole 19*b* is connected through a tube 32 to the recording head 12, whereas the fitting hole 19*c* is connected through a tube 33 to the head cleaning unit 18, and the fitting hole 19*d* is connected through an L-shaped air duct 34 to an air introduction hole 19*e* that is formed on a top side of the cartridge mounting section 19. Furthermore, the fitting holes 19*b*, 19*c* and 19*d* are respectively provided with hollow accessing needles 35, 36 and 37, which constitute a section of the tube 32 or 33 or the air duct 34 respectively. As the ink cartridge 21 is plugged in the slot 19*a*, the accessing needles 35, 36 and 37 stick into the ink outlet 26, the waste-ink inlet 27 and the air inlet 28, respectively, to protrude into the chambers 24 and 25. Thus, the recording ink storage chamber 24 is connected to the recording head 12 through the accessing needle 35 and the tube 32, whereas the waste-ink storage chamber 25 is connected to the head cleaning unit 18 through the accessing needle 36 and the tube 33.

The cartridge mounting section 19 is also provided with heaters 38 and cooling fans 39 which are arranged in correspondence with the respective slots 19*a*. Each of the heaters 38 comes into contact with the bottom of the ink cartridge 21 as the ink cartridge 21 is plugged in the slot 19*a*, and heats the ink coagulant 30 as contained in the waste-ink storage chamber 25 upon an electric voltage being applied. Each of the cooling fans 39 is opposed to the heat radiation fins 31 as the ink cartridge 21 is plugged in the slot 19*a*, and blows the heat radiation fins 31 to cool the ink coagulant 30.

The heaters 38 and the cooling fans 39 are connected to a temperature controller 40. When a command for coagulating the waste-ink, the temperature controller 40 applies the voltage to the heater 38 to melt the ink coagulant 30 and thereafter drives the cooling fan 39 to cool and solidify the ink coagulant 30. The temperature controller 40 drives the heaters 38 and the cooling fans 39 individually at timings predetermined according to physical properties of the ink coagulant 30, such as melting temperature, solidification temperature and heat capacity of the ink coagulant 30, capacity of the heater 38 and air volume of the cooling fan 39.

The head cleaning unit 18 has a number of caps 50 and a wiper 51. The caps 50 are formed from an elastic material like rubber, and are positioned to face the discharging surfaces of the respective colors while the recording head 12 is in the home position. The caps 50 are movable up and down by use of a not-shown mechanism, and are brought into contact with the recording head 12 after the recording head 12 is moved to the home position. Thus, the individual caps 50 cover the counterpart discharging surfaces to prevent evaporation or drying of the ink in the nozzles while the recording head 12 is at rest.

The wiper 51 consists of an elastic blade 52 made of rubber or the like, and a holder 53 holding the blade 52. The wiper 51 is placed on one side of the caps 50 in a moving direction of the carriage 13, and is adjusted in height such that a top edge of the blade 52 a little touches the discharging surface as the carriage 13 moves with the recording head 12 over the wiper 51. Thus, each time the carriage 13 moves from the home position to the recording area and moves back to the home position, the blade 52 wipes the discharging surfaces. Note that the blade 52 has a width extending across the discharging surfaces of the respective colors in a horizontally crossing direction to the moving direction of the carriage 13, though it looks like a rod from its sectional contour shown in FIG. 2. The wiper 51 is not limited to the illustrated embodiment. It is possible to make the wiper 51 movable up and down so as to wipe the discharging surface only when it is required. It is also possible to move the wiper 51 itself for wiping.

The tube 33 interconnecting between the head cleaning unit 18 and the fitting hole 19*c* is branched into two tubes 33*a* and 33*b* in the head cleaning unit 18, which are connected to the cap 50 and the wiper 51, respectively. The head cleaning unit 18 is further provided with a pump 54 for changing pressure inside the tube 33 to push the fluid in the tube 33 toward the waste-ink storage chamber 25.

The tube 33*a* is put through the cap 50 and connected to a recess 50*a* of the cap 50, so as to transmit the pressure variation of the pump 54 to the recess 50*a*. By driving the pump 54 while pressing the cap 50 onto the recording head 12, the waste-ink is sucked out of the nozzles and fed to the waste-ink storage chamber 25 of the associated cartridge 21. That is, the cap 50 and the pump 54 constitute a vacuum smoothing mechanism. On the other hand, the tube 33*b* is connected to a groove 53*a* between the holder 53 and the blade 52. The waste-ink sticking to the discharging surface of the recording head 12 is wiped off by the blade 52 with the movement of the carriage 13. The waste-ink wiped drains along the blade 52 into the groove 53*a*. So the waste-ink pooled in the groove 53*a* is sucked and sent to the waste-ink storage chamber 25 of the associated cartridge 21 also by driving the pump 54. Valves 55 and 56 are disposed in the tubes 33*a* and 33*b*, so as to switch on or off the transmission of the pressure change to the cap 50 and the wiper 51, as caused by the pump 54. Since the wiper 51 is commonly used for wiping all the discharging surfaces of the recording head 12, the wiper 51 may be connected to the waste-ink storage chamber 25 of only one of the ink cartridges 21 through the tube 33*b*. The tubes 33 as connected to other ink cartridges 21 are not branched, but connected to the caps 50 alone.

In the above embodiment, the caps 50 are provided for the discharging surfaces of the respective colors, so the waste-ink of each color is sucked out from the nozzles and collected in the waste-ink storage chamber 25 of the corresponding ink cartridge 21. However, it is possible to use a single cap that covers the discharging surfaces of all colors. In that case, the cartridge mounting section 19 may be provided with a device for delivering the waste-ink equally to the respective waste-ink storage chamber 25 of the ink cartridges 21.

Now the operation of the ink jet recording apparatus of the above embodiment will be described with reference to FIGS. 2 and 3.

When the ink cartridge 21 having the recording ink storage chamber 24 and the waste-ink storage chamber 25 is plugged in the slot 19*a* of the cartridge mounting section 19, the recording ink storage chamber 24 is connected to the recording head 12 through the accessing needle 35 and the tube 32, and the waste-ink storage chamber 25 is connected to the head cleaning unit 18 through the accessing needle 36 and the tube 33.

While the recording head 12 is at rest and not printing, the carriage 13 is held in the home position, and the caps 50 cover up the discharging surfaces of the recording head 12, to prevent evaporation of the recording ink in the nozzles. Immediately before and after the printing, as well as when a head cleaning command is entered, the head cleaning unit 18 opens the valve 55 and closes the valve 56 and then drives the pump 54. So the pump 54 sucks the sticky waste-ink and other obstacles out of the nozzles through the caps 50. The sucked waste-ink is fed through the tube 33 and the accessing needle 36 to the waste-ink storage chamber 25 of the ink cartridge 21.

When a printing command is entered, the carriage 13 begins to move from the home position to the recording area, and the blade 52 of the wiper 51 wipes the waste-ink off the discharging surfaces of the recording head 12. The wiped waste-ink drains along the blade 52 into the groove 53*a*. At a predetermined timing, e.g. when the carriage 13 moves completely into the recording area, the head cleaning unit 18 closes the valve 55 and opens the valve 56, and thereafter drives the pump 54. Then, the pump 54 sucks the waste-ink from the groove 53*a*, and sends it to the waste-ink storage chamber 25. Thus, the waste-ink as collected by the head cleaning unit 18 is stored in the waste-ink storage chamber 25.

Responsive to the printing command, the recording head 12 applies voltage to those piezoelectric elements corresponding to the pixels to record, so the associated oscillation plates are driven to change pressure inside the tube 32 to suck the recording ink from the recording ink storage chamber 24. The sucked recording ink is ejected from the outlet of the nozzles onto the paper sheet 11. The ink jet recording apparatus 10 drives the recording head 12 while moving the carriage 13 in the main scanning direction X across the recording area, and conveying the paper sheet 11 in the sub scanning direction Y. Thus, an image frame is printed on the paper sheet 11.

Figure 3A:
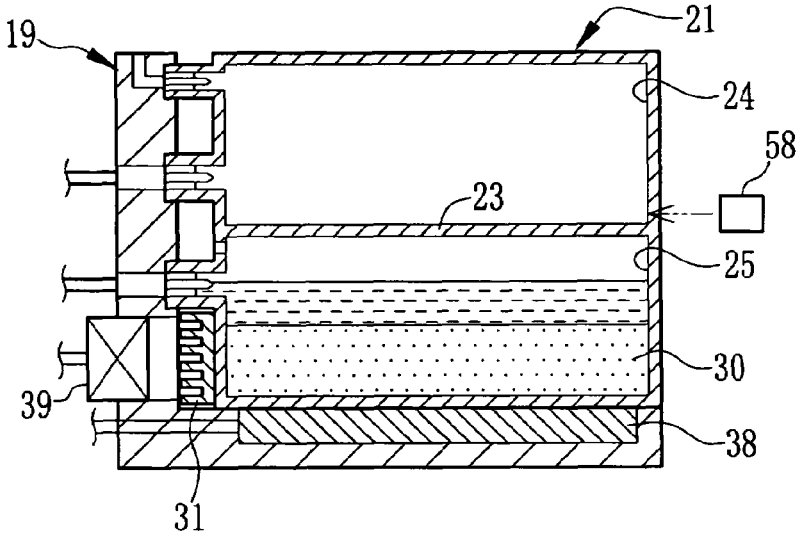
FIG. 3A, 3B and 3C are sectional views of the ink cartridge, illustrating different stages of reaction between waste-ink and an ink coagulant.
Figure 3B:
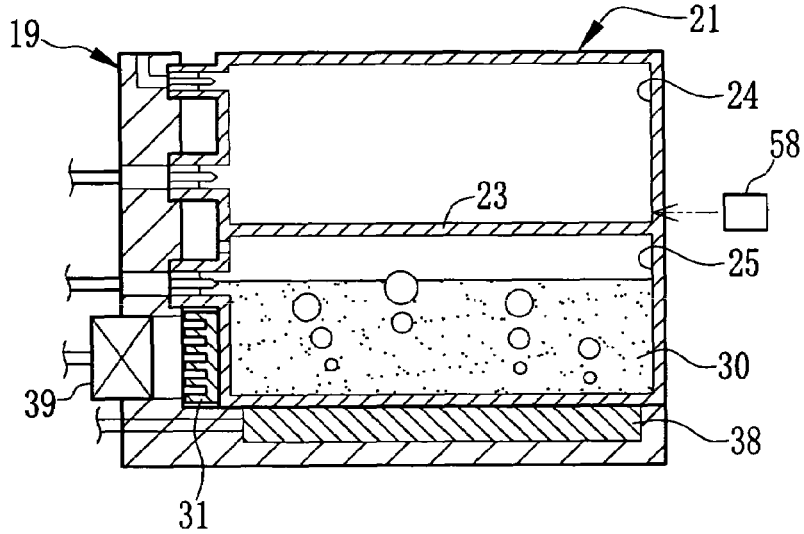
Figure 3C:
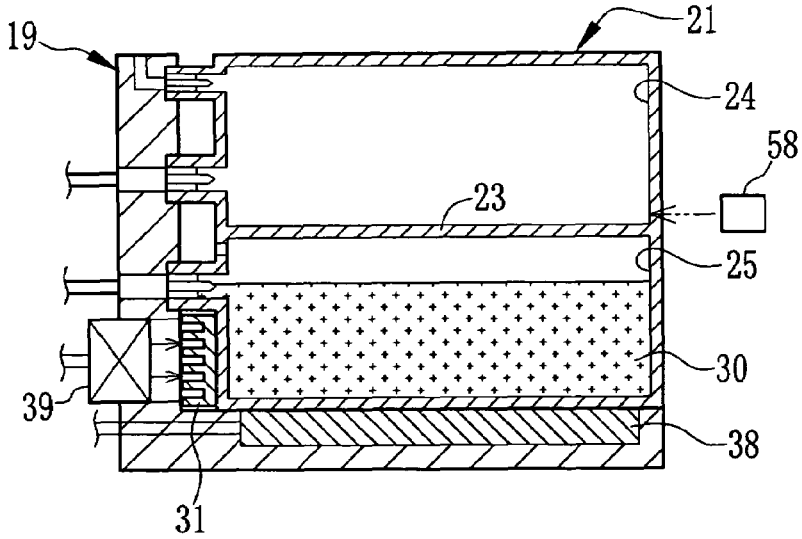

As the recording head 12 continues printing, the recording ink in the recording ink storage chamber 24 is finally used up, as shown in FIG. 3A. When the residual ink detection sensor 58 detects that the recording ink is used up, the ink jet recording apparatus 10 commands the temperature controller 40 to coagulate the waste-ink. Then, the temperature controller 40 applies a voltage to the heater 38 to heat the ink coagulant 30 up to its melting temperature at the predetermined timings. The melted ink coagulant 30 is mixed with the waste-ink, as show in FIG. 3B. After the ink coagulant 30 and the waste-ink are mixed up, the temperature controller 40 turns off the heater 38 to stop heating, and then drives the cooling fan 39 to start blowing the heat radiation fins 31 to cool the ink coagulant 30. As being cooled, the ink coagulant 30 is coagulated again to solidify the waste-ink into gel, as shown in FIG. 3C.

While solidifying the waste-ink, the ink jet recording apparatus 10 displays a message on a not-shown display device, to notify the user of the fact that one of the ink cartridges 21 has run out of the recording ink. Instead of displaying the message, it is possible to warn the ink run-out by use of a lamp or an LED, or acoustically by a speaker or the like.

Since the waste-ink is coagulated by the ink coagulant 30 when the user takes out the ink cartridge 21, the waste-ink would not leak out of the ink cartridge 21 through the accessing needle 36 or the vent hole 29. So the user can change the ink cartridge 21 with ease. By heating the used-up ink cartridge 21 after it is removed from the printer, the gelled mixture of the waste-ink and the ink coagulant 30 is liquefied again, making it easy to drain the waste-ink and the ink coagulant 30 out of the case body 22 through the waste-ink inlet 27 just by removing the filter and the valve mechanism from the waste-ink inlet 27. Accordingly, the case body 22 is easy to reuse or recycle. Furthermore, it is possible to reuse or recycle the ink coagulant 30 by separating the ink coagulant 30 from the waste-ink through washing, heating and drying processes.

Moreover, if a high water absorbent polymer is used as a coagulant for the waste-ink, and the solidified waste-ink is not properly treated but incinerated with combustible rubbish, it would produce hazardous substances like dioxin. On the contrary, according to the present embodiment, a naturally-derived material, such as agar, gelatin, karaginan or pectin, is usable as the ink coagulant 30. So the gelatinized waste-ink would not produce any hazardous substances even if it is incinerated.

In the above embodiment, the waste-ink is solidified when the output signal from the residual ink detection sensor 58 shows that the recording ink in the recording ink storage chamber 24 is used up. But the timing of solidifying the waste-ink is not limited to this embodiment. For example, it is possible to solidify the waste-ink each time the pump 54 of the head cleaning unit 18 is driven to suck and feed the waste-ink into the waste-ink storage chamber 25. This method eliminates the risk that the waste-ink can leak if the ink cartridge 21 is removed from the printer 10 before the residual ink detection sensor 58 detects the ink run-out. It is alternatively possible to count the number of times the pump 54 is driven, and estimate based on the count the amount of the waste-ink stored in the waste-ink storage chamber 25, so as to execute the solidification when the amount of the stored waste-ink reaches a predetermined value, e.g. a value permitting the ink coagulant 30 to coagulate the waste-ink. According to this alternative, the number of times driving the heater 38 and the cooling fan 39 is limited to a requisite minimum, so the power consumption is reduced.

Figure 4:
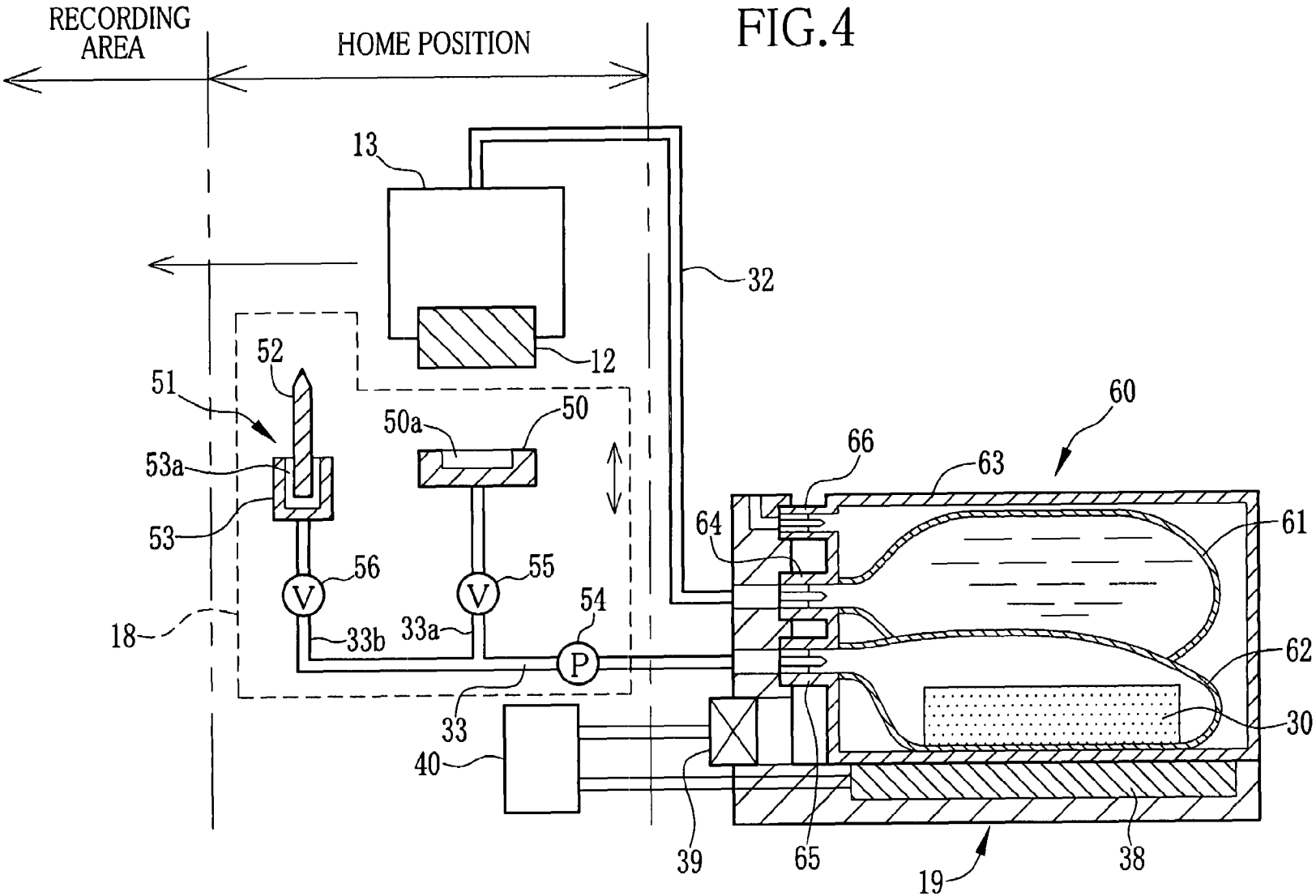
FIG. 4 is an explanatory diagram illustrating an ink cartridge having an ink bag and a waste-ink bag, according to another embodiment of the invention.

Although the case body 22 of the ink cartridge 21 is sectioned by the partition wall into the upper recording ink storage chamber 24 and the lower waste-ink storage chamber 25, it is alternatively possible to provide two flexible bags for containing the recording ink and the waste-ink, as show in FIG. 4, wherein like components are designated by the same reference numerals, so the detailed description of these components is omitted.

An ink cartridge 60 shown in FIG. 4 consists of a recording ink bag 61 containing a recording ink, a waste-ink bag 62 for containing the waste-ink, and a case body 63 encasing and protecting these ink bags 61 and 62. The case body 63 has on its one side an ink outlet 64 for letting the recording ink out of the recording ink bag 61, and a waste-ink inlet 65 for letting the waste-ink into the waste-ink bag 62. Openings of the respective ink bags 61 and 62 are joined from inside to the ink outlet 64 and the waste-ink inlet 65. An air inlet 66 is formed through the same side of the case body 22 as the ink outlet 64 and the waste-ink inlet 65. The air inlet 66 keeps pressure inside the case body 63 at atmospheric pressure. The waste-ink bag 62 contains a solid ink coagulant 30, like the waste-ink storage chamber 25 of the first embodiment. The waste-ink bag 62 is affixed to an inner bottom surface of the case body 63, for example by an adhesive agent, so that the heat from a heater 38 may be efficiently transmitted to the ink coagulant 30.

Using the ink cartridge 60, the waste-ink, which is collected from a recording head 12 by a head cleaning unit 18, is stored and solidified into gel in the waste-ink bag 62, by heating and cooling the ink coagulant 30. So the embodiment shown in FIG. 4 achieves the same effect as the first embodiment. In addition to that, the recording ink bag 61 deflates as the contained ink is consumed, whereas the waste-ink bag 62 swells as the waste-ink is fed into it. That is, the volumes of the ink bags 61 and 62 change oppositely to each other. Accordingly, it is possible to exploit the internal space of the case body 63 efficiently to minimize the ink cartridge 60.

Figure 5:
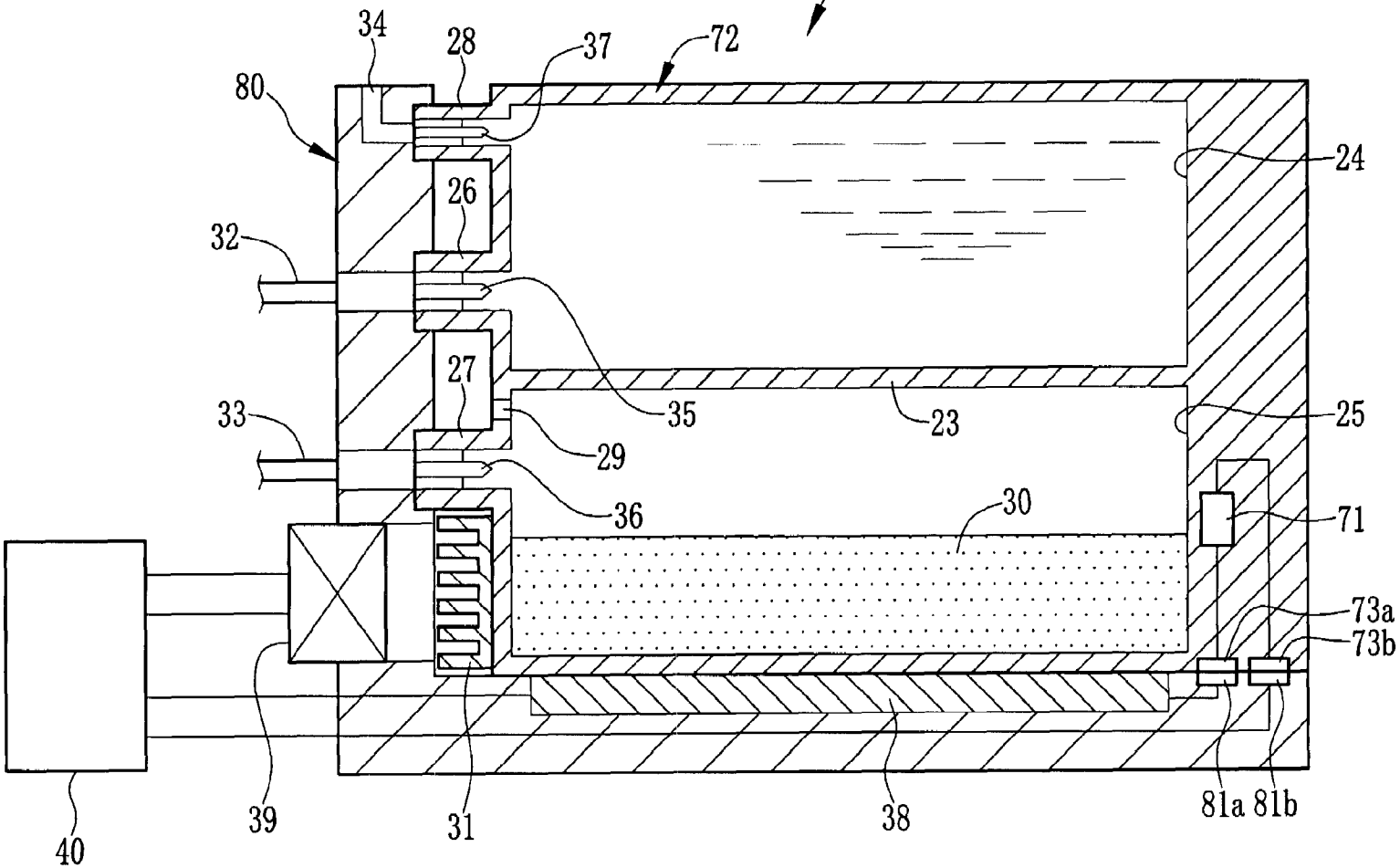
FIG. 5 is an explanatory diagram illustrating an ink cartridge that is provided with a thermal fuse, according to another embodiment of the invention.

In the above-described embodiment, the temperature controller 40 drives the heater 38 and the cooling fan 39 at the timings predetermined according to physical properties of the ink coagulant 30, capacity of the heater 38 and air volume of the cooling fan 39. According to another embodiment, as shown in FIG. 5, an ink cartridge 70 is provided with a thermal fuse 71, so as to drive a heater 38 and a cooling fan 39 when the thermal fuse 71 melts down.

The thermal fuse 71 is built in a case body 72 of the ink cartridge 70, and has a fusible alloy that melts down at a melt-down temperature that is predetermined according to the melting temperature of an ink coagulant 30. So the fusible alloy melts down when the ink coagulant 30 is heated up to melt by the heater 38. Two wires are led from the thermal fuse 71 to a couple of contact terminals 73*a* and 73*b*, respectively. The contact terminals 73*a* and 73*b* are built in a bottom portion of the case body 72. In correspondence with the contact terminals 73*a* and 73*b*, a couple of contact terminals 81*a* and 81*b* are built in a cartridge mounting section 80, so that the contact terminals 73*a* and 73*b* come into contact with the contact terminals 81*a* and 81*b* respectively as the ink cartridge 70 is plugged in a slot of the cartridge mounting section 80.

The contact terminal 81*a* is connected to one terminal of the heater 38, whereas the contact terminal 81*b* is connected to the temperature controller 40. The other terminal of the heater 38 is connected through a wire to the temperature controller 40. Thus, only while the ink cartridge 70 is mounted in the cartridge mounting section 80, the heater 38 is connected to the temperature controller 40 through the contact terminals 73*a*, 73*b*, 81*a* and 81*b* and the thermal fuse 71. So the thermal fuse 71 constitutes a section of the circuit interconnecting between the heater 38 and the temperature controller 40.

Upon a command for solidifying the waste-ink, the temperature controller 40 first applies a voltage to the heater 38 to heat the ink coagulant 30. When the ink coagulant 30 is heated up to the melting temperature and is mixed with the waste-ink in a waste-ink storage chamber 25 of the ink cartridge 70, the thermal fuse 71 melts down. As the thermal fuse 71 melts down, the heater 38 is disconnected from the temperature controller 40, so the heater 38 stops heating. The meltdown of the thermal fuse 71 is detected by the temperature controller 40, for example, by monitoring current or voltage. Then, the temperature controller 40 starts driving the cooling fan 39, to cool the ink coagulant 30.

In the first embodiment, the heater 38 and the cooling fan 39 are driven at the predetermined timings, so there is a risk that the ink coagulant 30 cannot reach the melting temperature or can be excessively heated due to variations in environmental temperature or humidity. If the ink coagulant 30 does not reach the melting temperature, it cannot mix well with the waste-ink. If the ink coagulant 30 is heated too much, the properties of the ink coagulant 30 will change. According to the embodiment shown in FIG. 5, because the ink cartridge 70 is provided with the thermal fuse 71, of which meltdown temperature corresponds to the melting temperature of the ink coagulant 30, the thermal fuse 71 melts down to stop the heater 38, so the risk of insufficient or excessive heating of the ink coagulant 30 is eliminated. Moreover, because the thermal fuse 71 prevents the excessive heating of the ink coagulant 30 and the waste-ink, the ink cartridge 70 contributes to improving the safety of the ink jet recording apparatus 10.

Instead of the thermal fuse 71, it is possible to provide a fusible member in the wiring from the contact terminal 73*a* to the contact terminal 73*b*, which is built in the ink cartridge 70. The fusible member is made of a material fusible at a temperature corresponding to the melting temperature of the ink coagulant 30, e.g. a low-melting point resin. Then, the fusible member is fused to disconnect the wiring when the case body 72 reaches a certain temperature.

Although the ink coagulant 30 is previously contained in the waste-ink storage chamber 25 or in the waste-ink bag 62 in the above embodiment, it is possible to mix a powdery ink coagulant previously in the recording ink. According to this embodiment, the content of the ink coagulant in the recording ink is constant, so the gelatinized mixture of the waste-ink and the ink coagulant is always kept in the same condition.

In the above embodiment, the heater 38 is used merely for solidifying the waste-ink. But it is possible to use the heater 38 for heating the recording ink while the recording head 12 is printing an image. Heating the recording ink lowers the viscosity of the recording ink and thus reduces the viscous resistance of the recording ink to the tubes. As a result, stability on supplying the recording ink to the recording head 12, as well as on ejecting the recording ink from the nozzles is improved.

Although the present invention has been described with respect to those ink cartridges where the recording ink storage chamber and the waste-ink storage chamber are integrated into the same ink cartridge, the present invention is not to be limited to these embodiments. It is possible to provide a waste-ink cartridge that previously contains the ink coagulant 30 separately from an ink cartridge that contains the recording ink as usual, and mount the waste-ink cartridge and the ink cartridge in the ink jet recording apparatus of the present invention.

Thus the present invention is not to be limited to the above-described embodiments, but various modifications will be possible without departing from the scope of claims as appended hereto.

What is claimed is:

1. An ink cartridge for supplying ink to an ink jet type recording head that has nozzles to discharge the ink toward a recording material to record an image, said ink cartridge comprising:

a recording ink storage portion storing the ink to be supplied to said recording head;

a waste-ink storage portion for storing waste-ink collected by cleaning said recording head; and an ink coagulant contained in said waste-ink storage portion, wherein said ink coagulant, in response to an output signal from a residual ink detection sensor indicating that the ink in said recording ink storage portion is used up, melts as heated up to a given melting temperature and mixes with the stored waste-ink and, thereafter, solidifies the stored waste-ink as cooled, wherein the solidified waste-ink and said ink coagulant are configured to be liquefied again as heated up to the melting temperature, and are configured to be solidified again as cooled.

2. An ink cartridge as claimed in claim 1, wherein said ink coagulant is made of at least one of agar, gelatin, karaginan and pectin.

3. An ink cartridge as claimed in claim 1, wherein said ink coagulant is contained as a solid, powders or flakes in said waste-ink storage.

4. An ink cartridge as claimed in claim 1, wherein said recording ink storage portion and said waste-ink storage portion are provided by sectioning a case body of said ink cartridge into two chambers.

5. An ink cartridge as claimed in claim 4, further comprising an ink outlet for letting recording ink out of said recording ink storage portion and a waste-ink inlet for letting waste-ink into said waste-ink storage chamber, wherein the ink outlet and inlet are providing on one side of the case body.

6. An ink cartridge as claimed in claim 5, further comprising heat radiation fins provided on the same side of the case body as the ink outlet and inlet are formed.

7. An ink cartridge as claimed in claim 6, wherein the heat radiation fins are integrally formed with the case body.

8. An ink cartridge as claimed in claim 1, wherein said recording ink storage portion and said waste-ink storage portion are constituted of two ink bags contained in a case body of said ink cartridge.

9. An ink jet recording apparatus having a recording head for discharging ink from nozzles onto a recording material, wherein outlets of said nozzles are arranged in a discharging surface, comprising:

a cartridge mounting section for removably mounting at least an ink cartridge that has a waste-ink storage portion for storing waste-ink collected from said recording head, and at least a recording ink storage portion storing the ink to be supplied to said recording head, said waste-ink storage portion containing an ink coagulant that melts as heated up to a given melting temperature and mixes with the stored waste-ink and, thereafter, solidifies the stored waste-ink as cooled;

a head cleaning device for cleaning said recording head to collect the waste-ink and feed the collected waste-ink to said waste-ink storage portion of said ink cartridge as mounted to said cartridge mounting section;

a heating device for heating said ink cartridge as mounted to said cartridge mounting section;

a temperature controller for driving said heating device to heat said ink cartridge till said ink coagulant is melted into the stored waste-ink; and a detection device for detecting that the ink in said recording ink storage portion is used up, wherein said temperature controller starts driving said heating device when said detection device detects that the ink is used up, wherein the solidified waste-ink and said ink coagulant are configured to be liquefied again as heated up to the melting temperature, and are configured to be solidified again as cooled.

10. An ink jet recording apparatus as claimed in claim 9, wherein said head cleaning device comprises at least one of a vacuum smoothing mechanism for sucking the ink and any obstacles out of said nozzles, and a wiper for wiping the ink off said discharging surface, and feeds the ink sucked by said vacuum smoothing mechanism and/or the ink wiped off said discharging surface as the waste-ink to said waste-ink storage portion.

11. An ink jet recording apparatus as claimed in claim 9, further comprising a device for detecting or estimating the amount of the waste-ink stored in said waste-ink storage portion, and said temperature controller starts driving said heating device when the amount of the stored waste-ink is detected or estimated to reach a predetermined value.

12. An ink jet recording apparatus as claimed in claim 9, wherein said ink cartridge is provided with a breaking device that is connected to a circuit between said heating device and said temperature controller, to constitute a section of said circuit as said ink cartridge is mounted to said cartridge mounting section, said breaking device disconnecting said heating device from said temperature controller when said ink coagulant reaches the melting temperature, thereby to deactivate said heating device.

13. An ink jet recording apparatus as claimed in claim 12, wherein said breaking device is a thermal fuse having a melt-down temperature corresponding to the melting temperature of said ink coagulant.

14. An ink jet recording apparatus as claimed in claim 9, further comprising a cooling device for cooling said ink cartridge as mounted to said cartridge mounting section, wherein, after said ink coagulant melts into the stored waste-ink, said temperature controller stops driving said heating device and starts driving said cooling device to cool and solidify the stored waste-ink.

15. An ink jet recording apparatus as claimed in claim 9, wherein said temperature controller drives said heating device not only to melt said ink coagulant but also to change the viscosity of the ink as supplied to said recording head while recording an image.

16. A waste-ink cartridge for use with an ink jet type recording head that has nozzles to discharge ink toward a recording material to record an image, said waste-ink cartridge comprising:

a waste-ink storage portion for storing waste-ink collected by cleaning said recording head; and an ink coagulant contained in said waste-ink storage portion, wherein said ink coagulant melts as heated up to a melting temperature and mixes with the stored waste-ink and, thereafter, solidifies the stored waste-ink as cooled, wherein the solidified waste-ink and said ink coagulant are configured to be liquefied again as heated up to the melting temperature, and are configured to be solidified again as cooled.

17. A waste-ink cartridge as claimed in claim 16, wherein said ink coagulant is made of at least one of agar, gelatin, karaginan and pectin.

* * * * *